US006416011B2

(12) United States Patent
Granger

(10) Patent No.: US 6,416,011 B2
(45) Date of Patent: Jul. 9, 2002

(54) DISPENSING MACHINE FOR WIPE MATERIAL WITH THE REEL IN A FRONTAL POSITION

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/796,317

(22) Filed: Feb. 28, 2001

Related U.S. Application Data

(63) Continuation of application No. PCT/FR99/01915, filed on Mar. 8, 1999.

(30) Foreign Application Priority Data

Sep. 28, 1998 (FR) ..... 98 12272

(51) Int. Cl.[7] ..... B65H 16/04; B65H 23/04; B65H 23/08

(52) U.S. Cl. ..... 242/422.4; 242/416; 242/571.5; 242/597.4

(58) Field of Search ..... 242/416, 422.4, 242/571.5, 597.3, 597.4; 312/34.8, 34.19, 34.22; 225/46, 47, 16; 83/334, 335

(56) References Cited

U.S. PATENT DOCUMENTS 3,531,057 A * 9/1970 Way ..... 242/410
3,974,974 A * 8/1976 Nishikawa ..... 242/422.4
4,842,215 A * 6/1989 Takami
4,984,915 A * 1/1991 Tashiro et al. ..... 242/571.5
5,577,686 A * 11/1996 Moody ..... 242/597.4
5,769,350 A * 6/1998 Oka ..... 242/422.4
5,937,718 A * 8/1999 Granger ..... 83/334
5,947,409 A * 9/1999 Corrigan ..... 242/571.5
6,036,134 A * 3/2000 Moody ..... 242/422.4

FOREIGN PATENT DOCUMENTS

| | | |
|---|---|---|
| EP | 157713 | 10/1985 |
| FR | 2592022 | 6/1987 |
| WO | 95 26157 | 10/1995 |
| WO | 96 03912 | 2/1996 |

* cited by examiner

*Primary Examiner*—John M. Jillions
(74) *Attorney, Agent, or Firm*—Wall Marjama & Bilinski LLP

(57) ABSTRACT

A dispensing machine for wipe material with the reel in a frontal position of the type includes a housing (2), a cover (3), a drum (4), a cutting device (5–6) built into the drum, a cam and start sprig for starting and returning the drum and a device to prevent loops in the material paid out from the reel (B) of material. The device includes a reel holder (16) capable of engaging and positioning itself on a fixed support (17) physically joined to the rear wall of the bottom of the housing, said reel holder being rotatably mounted on support (17) in opposition to a spring and in that the reel holder is devised to position itself on a long bearing surface **(17*b*) of support (17)**, being locked into position relative to the latter and in that the reel holder co-operates with the core or spindle of the reel of wipe material in order to drive it.

11 Claims, 4 Drawing Sheets

DISPENSING MACHINE FOR WIPE MATERIAL WITH THE REEL IN A FRONTAL POSITION

This appln is a cont of PCT/FR99/01915 filed Mar. 8, 1999.

FIELD OF THE INVENTION

The invention relates to the technical field of machines for dispensing wipes made of paper, cellulose wadding, crêpe paper or similar materials intended, in particular, for wiping users' hands, the dispensing of toilet paper and paper towels. The paper may be in folded or unfolded form.

BACKGROUND OF THE INVENTION

The Applicant has developed numerous patents for dispensers of the above-mentioned type, both automatic and semi-automatic, for dispensing strips of paper from a load reel.

The reels of wipe material can be presented in two ways:

Either the reel is mounted on a spindle or core that is physically joined to the housing of the machine so that it exposed the lateral face and diameter of said frontally mounted reel, making it possible to view the wound turns and the amount that has been dispensed.

Or the reel is mounted between two reel-holder end flanges arranged at right angles to the rear wall of the housing making it possible to present the reel lengthways.

This invention refers more specifically to the dispensing of coiled wipe materials in the above-mentioned first version.

The main components of such a machine, as described in French Patent 2.332.215 which is applicable to the various above-mentioned versions are briefly summarised below. A machine for dispensing material wipes, referred to in its entirety as (1), comprises a housing (2), a cover (3), a drum (4), a cutting device (5–6) built into the drum as well as means of starting and returning the drum including a cam (7) and a spring (8). The upper part of the housing is designed with means of support (9) capable of accommodating the reel of wipes (B) to be dispensed.

A machine of this type is generally used to dispense toilet paper or paper towels or paper hand wipes.

The tensile force exerted by the user on the strip of paper is liable to vary considerably and may be a greater or lesser force, not to mention the direction of the tensile force which can be an additional parameter that affects the operation of the dispensing machine. Exerting such a variable force may produce loops between the reel of wipe material and the drum over a length of strip that can be several centimeters or even several dozen centimeters long.

In order to overcome this drawback, the Applicant developed anti-loop devices, particularly in Patent FR No. 2.643.808. These anti-loop devices use swivelling-lever assemblies that are mounted relative to the reel holder and capable of having a swivelling effect in order to reduce or compensate the forming of loops and tension the strip of material. Such assemblies operate very satisfactorily but are likely to obstruct the loading of the machine since they face and are in the frontal plane of the reel of material.

The Applicant has developed, in its patent application FR 98.06702, an anti-loop device which is particularly applicable to dispensing machines that have lateral end shields to accommodate a reel holder and are therefore equivalent to the second version as stated earlier. The device described in this patent involves devising the reel holder end shields with an end fitting which allows the reel to be mounted with an elastic return means once it has been subjected to a tensile force.

The arrangements described in this patent application are strictly applicable to a presentation of the reel of wipes in a position where it faces the opening in the cover of the machine.

SUMMARY OF THE INVENTION

The object sought after according to the invention was to design the dispensing machine for applications involving presentation of reels of wipes in the frontal plane of the machine in order to ensure an anti-loop effect.

Another object sought after by the invention was to ensure the reel was locked in position on its support spindle.

These objects and others will become apparent from the rest of the description.

According to a first characteristic, the dispensing machine for wipe material with the reel in a frontal position of the type comprising a housing, cover, drum, cutting device built into the drum, means of starting and returning the drum including a cam and a start spring is distinctive in that it comprises a device to prevent loops in the material paid out from the reel of material, said device being distinctive in that it comprises a reel holder capable of engaging and positioning itself on a fixed support forming a hub that is physically joined to the rear wall of the bottom of the housing, said reel holder being rotatably mounted on the support in opposition to an elastic return means and in that said reel holder is designed to position itself on a long bearing surface of the support, being locked into position relative to the latter and in that the reel holder co-operates with the spindle or core of the reel of wipe material in order to drive it.

BRIEF DESCRIPTION OF THE DRAWINGS

The invention is explained below in greater detail, reference being made to the accompanying drawings in which.

DESCRIPTION OF THE INVENTION

Figure 1:
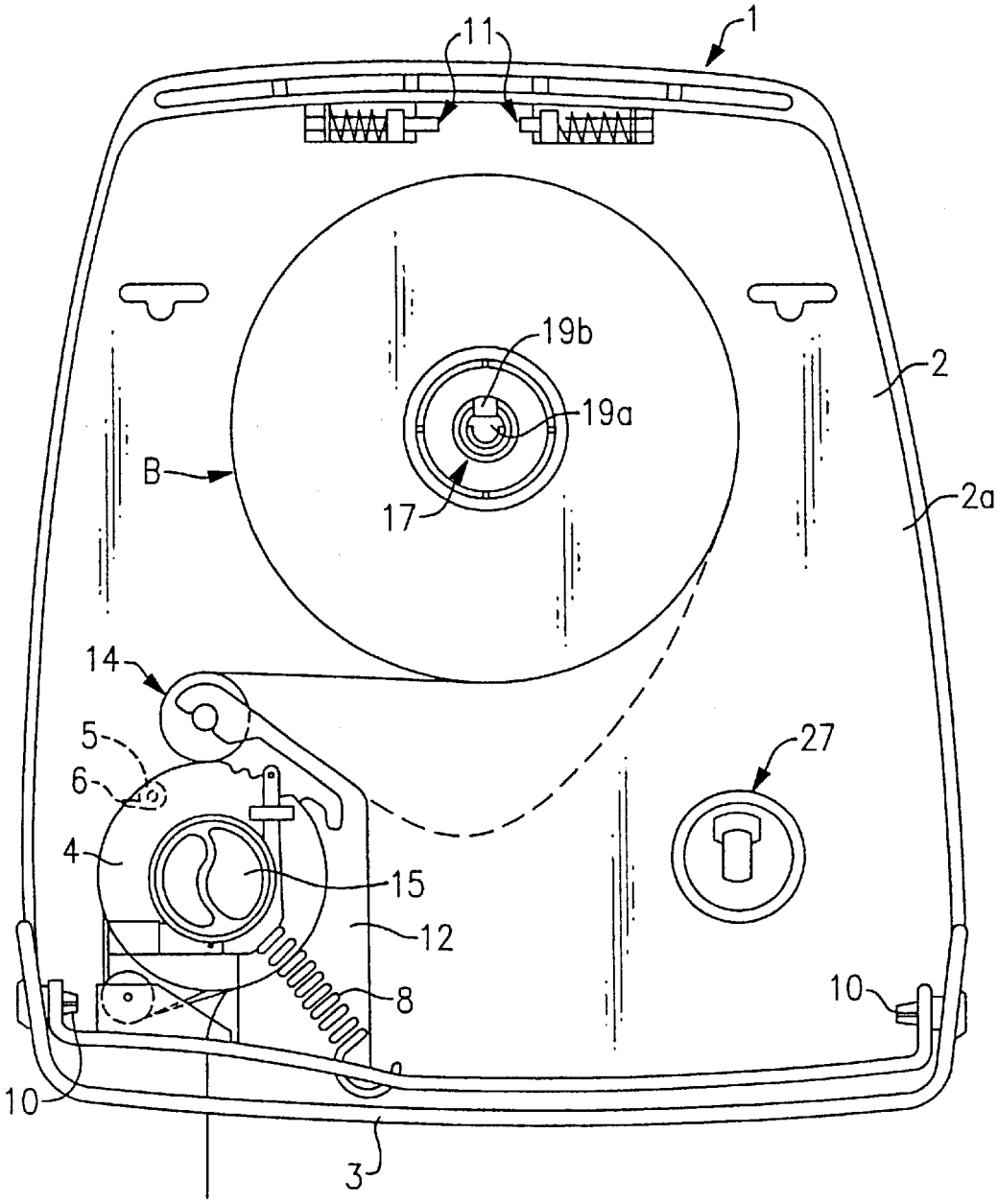
FIG. 1 is a front view of a machine for dispensing wipe material according to the invention, with the cover having been swivelled.
Figure 2:
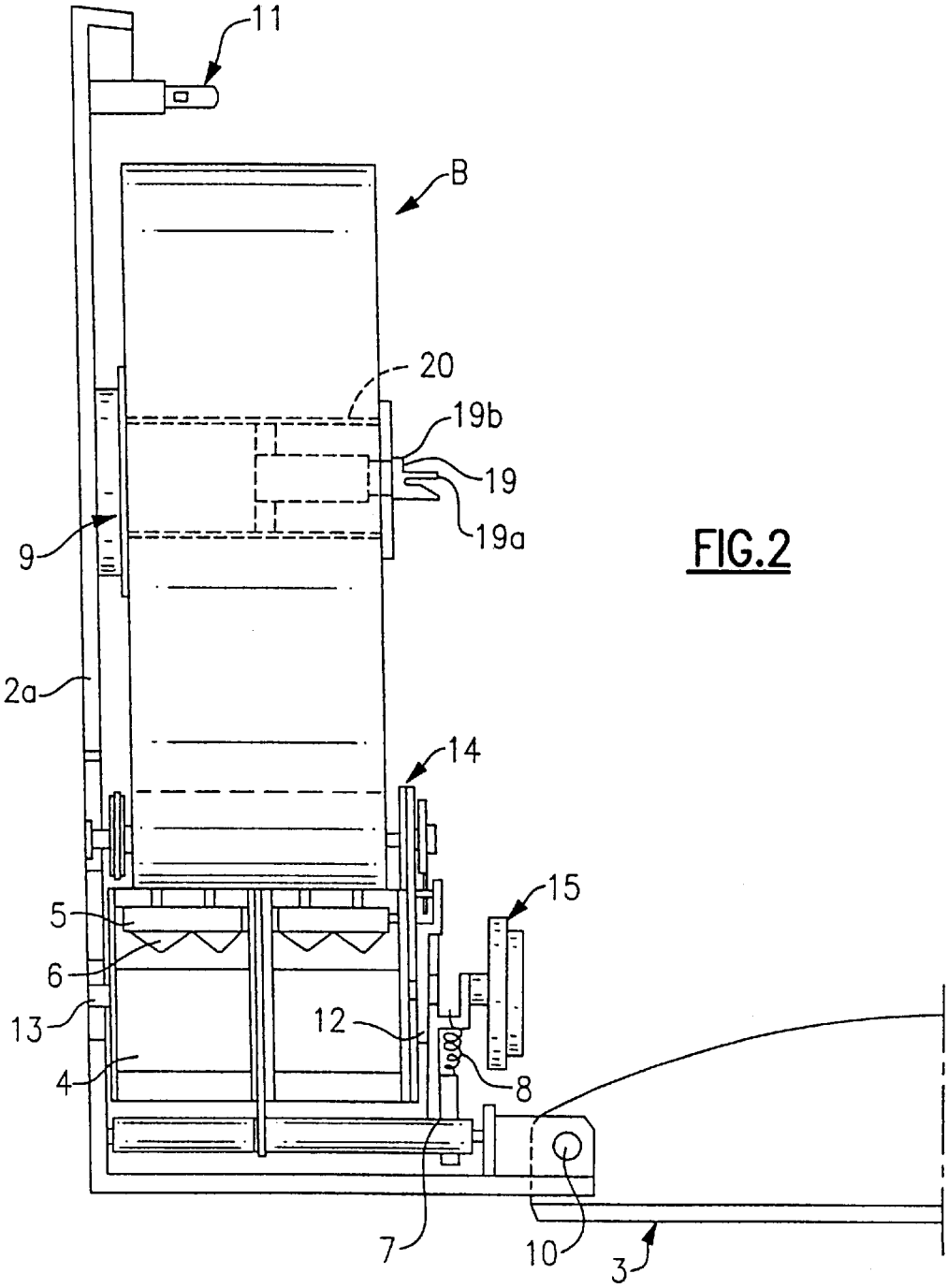
FIG. 2 is a side view of the dispensing machine according to FIG. 1 with the cover having been swivelled.

In order that the invention may be more readily understood, it is described in a non-exhaustive manner, reference being made to the accompanying drawings.

The dispensing machine for wipe material is referred to in its entirety as (1). This machine is designed to allow the dispensing of a reel of wipe material (B) which is frontally presented relative to the bottom wall **(2*a*) of the machine's housing so as to expose one of its lateral ends when cover (3)** is swivelled and opened.

The lower part of the cover is hinged to the housing by means of a swivel pin (10) and, when it is closed, it is locked in position on the top of the housing with the aid of means (11) which is familiar to those skilled in the art. The reel of wipe material is positioned in the upper part of the machine at an appropriate height depending on its initial diameter. The lower part of the machine has a mechanism for cutting the strip of material paid out from the reel. This mechanism may, for example, be of the type described in the Applicant's previous patent No. FR 2.332.215. This mechanism comprises a drum (4) rotatably mounted relative to lateral support end shields (12) and a shaft (13) arranged in the lower part of the machine's housing. The cutting device (5–6) is built into the drum and means of starting and returning (7–8) the drum, with a cam and a spring, are suitably arranged as disclosed in the above-mentioned French patent. A pressure roller (14) that can be located so that it presses against the top of the drum, thus allowing the end of the strip of paper originating from the reel to be inserted between the drum and the pressure roller with a view to subsequently dispensing it. An operating knob (15) is fitted at the end of the drum's shaft.

The characteristics of the invention are described below:

The reel of material is mounted on a reel holder referred to in its entirety as (16) which is itself capable of engaging on a support (17) forming a hub that is physically joined to the bottom rear wall **(2*a*) of the housing. This support (17) has a shaped, circular end shield (17*a*), for example, which is capable of engaging and locking onto a cylindrical shoulder (2*b*) on the bottom surface of the housing. This cylindrical shoulder is located so that it protrudes towards the front of the wall of the housing and makes it possible to fix the end shield (17*a*) by means of screws (18) or equivalent means. The support (17) has, in the plane that is perpendicular to its end shield (17*a*) and towards the front, a long bearing surface (17*b*) having a cylindrical configuration which makes it possible to centre and position reel holder (16). More particularly, this bearing surface (17*b*) has a support area (17*b*1) capable of accommodating a part forming a bush (16*a*) of reel holder (16). End (17*c*) of this bearing surface (17*b*) is tapered and, its end has a retractable, swivelling locking pin (19), the function of which is to hold, in particular, reel holder (16) in position as is described below. To achieve this, end (17*c*) of bearing surface (17*b*) of support (17) has, in a non-exhaustive configuration, slits (17*d*) between which locking pin (19) is formed, the latter being flexible and elastic and therefore capable of movement when a pressure force (F) is exerted. Pin (19) is therefore in the form of a support tab (19*a*) with a protruding shape (19*b*)** acting as a limit stop.

Reel holder (16) comprises a long external bearing surface **(16*b*) capable of engaging in core (20) of the reel of wipe material (B). Said bearing surface (16*b*) extends on one side as a collar (16*c*) constituting a limit stop surface for the reel of wipe material (B). The internal part of reel holder (16) is designed with a bush (16*a*) having a length greater than that of bearing surface (17*b*) with, at its end, a ring-shaped constriction (16*d*). Reel holder (16) thus makes it possible to center and position reel (B) which rests against cylindrical bearing surface (16*b*) and internal bush (16*a*), an internal chamber (16*e*) making it possible to engage and fix a flat spiral spring (21). One end (21*a*) of the latter is hook shaped so that it engages in a slit (16*f*) forming a recess on the peripheral wall of said bearing surface (16*b*). The other end (21*b*) of spring (21) is also hook shaped and attaches to a protruding pin (22) on end shield (17*a*) of support (17). Reel holder (16) is thus rotatably mounted on above-mentioned fixed support (17). When the reel of wipe material (B) rotates due to the effect of the tensile force exerted on the end of the strip of material by the user, this rotates the reel holder because it is tightly pressed against core (20)** of said reel. This rotation of the reel holder takes place in opposition to the spring which is subjected to a maximum twisting force over one revolution in order to correct and eliminate, as is indicated below, the formation of any loops after the strip of paper is pulled. Choosing a spiral spring makes it possible to correct and eliminate loops having a length of up to roughly 75 centimeters, i.e. equivalent to the circumference of a reel having a diameter of the order of 25 centimeters. In practice, correction of the loop length is closely linked to the circumference of the reel.

Figure 3:
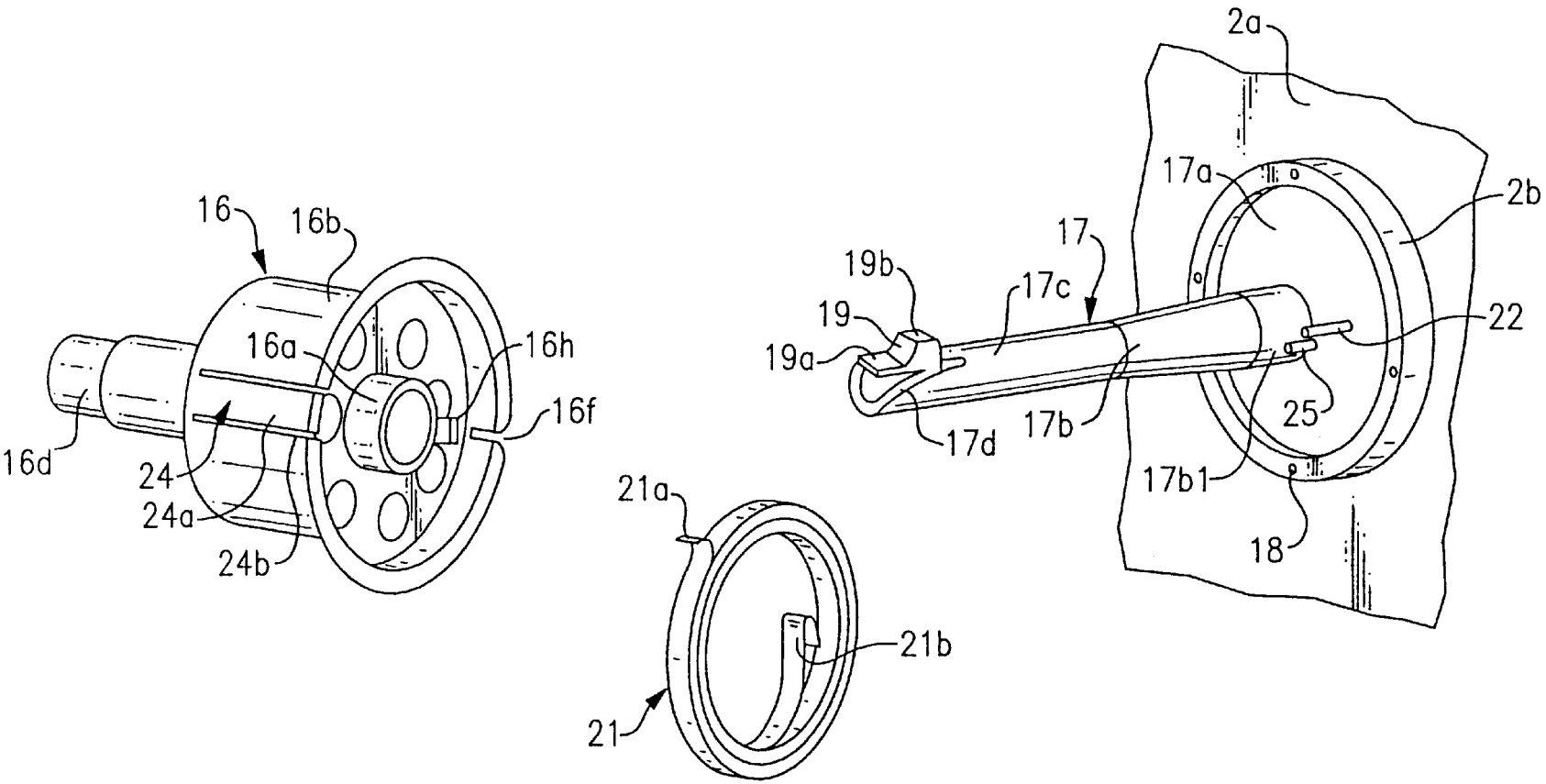
FIG. 3 is an enlarged, exploded view before the component parts of the device according to the invention have been fitted.
Figure 4:
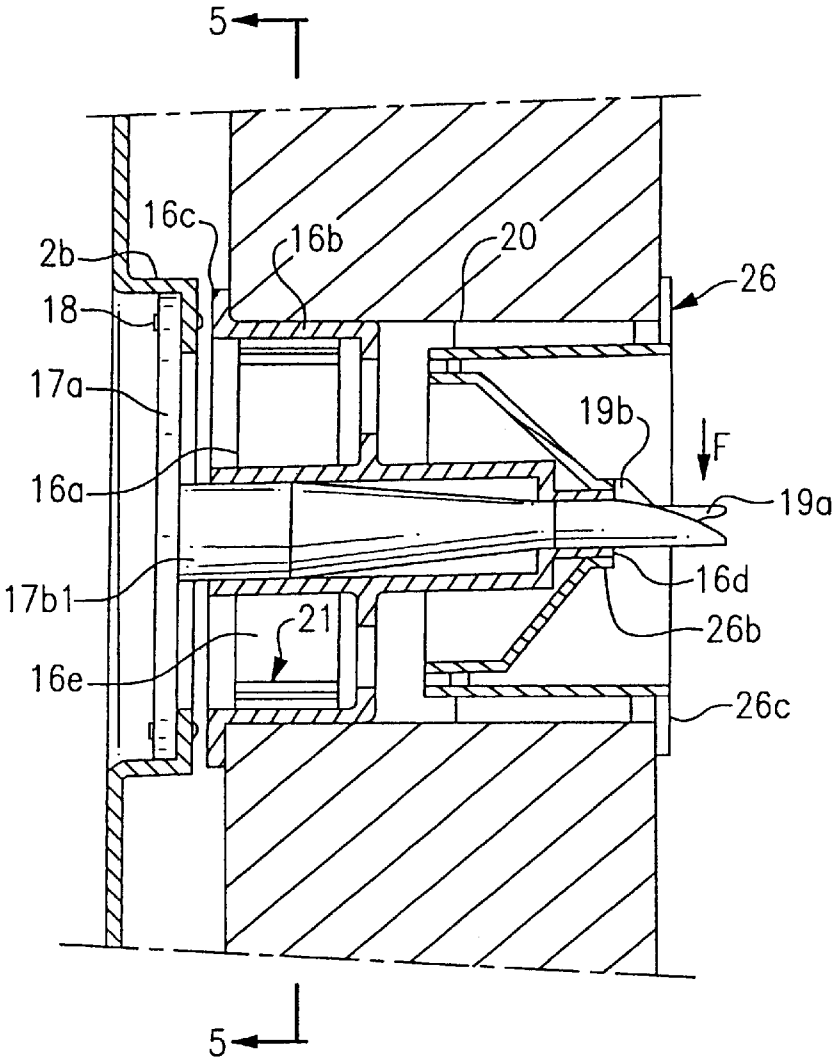
FIG. 4 is an enlarged partial view of the device according to the invention after installing the reel on its core.
Figure 5:
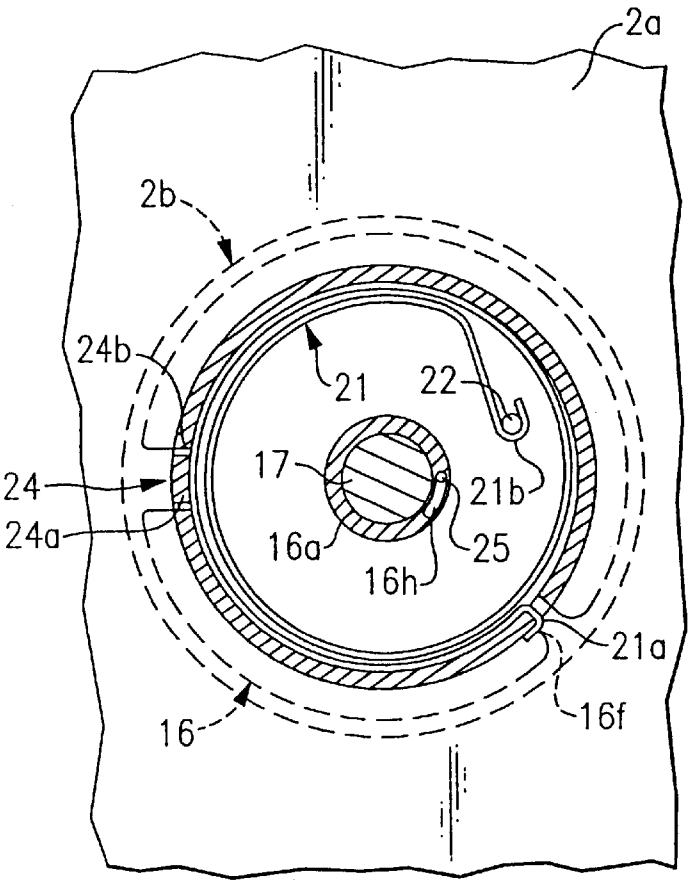
FIG. 5 is a front sectional view along line 5—5 in FIG. 4.

In order to ensure the reel of material (B) has a good grip on reel holder (16) the external periphery of the bearing surface **(16*b*) of the reel holder is designed with one or more means (24) that ensure a pressure and drive effect with reel core (20). This or these friction means (24) may be achieved through a multitude of projections that are an integral part of reel holder (16) when it is molded. Alternatively and preferably, as shown in FIGS. 3 and 5, the friction means (24) consists of a transverse tongue (24*a*) on the cylindrical bearing surface (16*b*) of reel holder (16). This tongue is made between two slits (24*b*) made on one part of the width of bearing surface (16*b*) making said tongue capable of a certain amount of elastic deflection in order to ensure it comes into contact with core (20)** of reel (B).

Also, in order to ensure limited rotation over one revolution of reel holder (16) relative to the fixed support, the latter is devised with a protruding stub (25) located adjacent and parallel to cylindrical bearing surface **(17*b*) of the support. The reel holder (16) has, towards the lower part forming a bush, a protruding bump (16*h*) forming a limit stop on stub (25), thus limiting rotation of the reel holder on support (17)**.

Also, an additional end fitting (26) is located towards the front of the reel holder and is capable of engaging in the core (20) of the reel of wipe material through its front. This end fitting (26) is of one-piece construction and has an internal taper shape **(26*a*) that extends internally as a cylindrical bearing surface (26*b*) capable of resting against the ring-shaped constriction (16*d*) of bush (16*a*) of reel holder (16) and against the locking pin (19) associated with the support (17)** of the reel holder.

The operation of the machine will now be described. A reel (B) of wipe material is installed by introducing its core (20) onto reel holder (16) in a position such that locking pin (19) on support (17) of reel holder (19) locks said reel into position. The reel is therefore secured between collars **(16*c*) (26*c*) formed, on the one hand, on the reel holder and, on the other hand, on end fitting (26). When the machine operates, the user exerts a tensile force on the strip of material which passes through the cutting mechanism described earlier. Rotation of the reel causes rotation of the reel holder, thus tensioning spring (21)**. This rotation of the reel holder causes stretching of the spring. The above-mentioned limit-stop makes it possible to limit the tensioning of the spring over on revolution. If the tensile force continues to be exerted on the strip of material, the core slips on the reel holder and thus slips on the tongue.

As shown in FIG. 1, the strip of material may, after pulling and cutting, contain a loop (dashed line). When this tensile force is no longer exerted, this allows the reel holder, under the effect of the resiliency and elastic return of the spring, to rotate in the opposite direction, thus automatically eliminating the loop.

FIG. 1 additionally shows a support means for a spare reel of material.

The advantages are clearly apparent from the description. The simple, quick installation of the reel of material and its locking in position are emphasised in particular. The constant tensioning of the strip of paper thanks to the return force obtained after each pull is also underlined. The reel holder is advantageously made of a single piece of plastic. The same applies to the support of said reel holder. The components can be assembled quickly. Alternatively, fixed support (17) can be directly moulded onto the bottom wall **(2*a*) of the housing so that, in this embodiment, there is only one separately mounted plastic part, namely the reel holder. Above-mentioned spring (21)** must also be added.

What is claimed is:

1. A dispensing machine for material wipes with a reel of paper material in a frontal position, said machine comprising a housing having a cover, a drum disposed within the housing, a cutting device built into the drum, means for starting and returning the drum including a cam and a start spring and a device to prevent loops in the material paid out from reel of paper material, said device comprising a reel holder for engaging and positioning itself on a fixed support physically jointed to a rear wall of the housing, said reel holder being rotatably mounted on the fixed support in opposition to an elastic return means, said reel holder is being positioned on a long bearing surface of the fixed support, being locked into position relative to the latter wherein the reel holder cooperates with a core of the reel of wipe material in order to drive it; and wherein the fixed support includes an end shield physically joined to a bottom surface of the housing and having, in a forward perpendicular plane, the long bearing surface having a cylindrical configuration to center and position the reel holder on the one hand and lock the reel of paper material and the reel holder in position on the other hand after inserting the latter into the reel holder.

2. Dispensing machine as claimed in claim 1, wherein the long bearing surface of the fixed support includes a support area making it possible to center and position the reel holder, said long bearing surface having a tapered end including a retractable, swiveling locking pin which locks the reel holder and reel into position.

3. Dispensing machine as claimed in claim 2, wherein the tapered end of the long bearing surface of the fixed support has slits between which the locking pin formed, the latter being flexible and therefore movable when a pressure force (F) is exerted, said pin having a support tab and a protruding shape acting as a limit stop.

4. Dispensing machine as claimed in claim 2, wherein the reel holder includes an external bearing surface for engaging in the core of the reel of wipe material, the internal part of said reel holder having a long bush resting against the long bearing surface of the fixed support and has, at its end, a ring-shaped constriction in order to rest and lock against the locking pin.

5. Dispensing machine as claimed in claim 4, wherein the reel holder has, internally between its external bearing and the internal bush, an internal chamber for engaging and fixing said elastic return means in the form of a spring, one end of said spring being physically attached to the reel holder and a remaining end of said spring being physically attached to the fixed support.

6. Dispensing machine as claimed in claim 5, wherein one end of the spring of said elastic return means is hook shaped for engagement in a slit forming a recess on a peripheral wall of the external bearing surface of said reel holder and the remaining end of said spring being hook shaped to attach a protruding pin on the end shield of the fixed support.

7. Dispensing machine as claimed in claim 5, wherein the reel holder has, on the external periphery of its external bearing surface, one or more friction means for ensuring a pressure and drive effect with the core of the reel.

8. Dispensing machine as claimed in claim 7, wherein each of the one or more friction means includes a transverse tongue on the external bearing surface of the reel holder, said tongue being defined by a pair of slits in said bearing surface, thus making the tongue elastic.

9. Dispensing machine as claimed in claim 1, wherein the fixed support includes a protruding stub that cooperates with a bump on the reel holder to ensure limited rotation of said reel holder.

10. Dispensing machine as claimed in claim 2, including a one-piece end fitting for engaging in the core of the reel of paper material through a front side thereof, said one-piece and fitting comprising an internal tapered shape that extends as a cylindrical bearing surface capable of resting against the forward part of the bush of the reel holder and against the locking pin associated with the fixed support of the reel holder.

11. Dispensing machine as claimed in claim 1, wherein the fixed support is a one-piece construction and is integral with a bottom wall of the housing.

* * * * *